US008683655B2

(12) United States Patent
Hong

(10) Patent No.: US 8,683,655 B2
(45) Date of Patent: Apr. 1, 2014

(54) SEPARATED TYPE HINGE APPARATUS WITH RETURN FUNCTION

(76) Inventor: Chan Ho Hong, Ansan-si (KR)

( * ) Notice: Subject to any disclaimer, the term of this patent is extended or adjusted under 35 U.S.C. 154(b) by 67 days.

(21) Appl. No.: 12/936,202

(22) PCT Filed: Aug. 5, 2008

(86) PCT No.: PCT/KR2008/004538

§ 371 (c)(1),
(2), (4) Date: Oct. 1, 2010

(87) PCT Pub. No.: WO2009/123381

PCT Pub. Date: Oct. 8, 2009

(65) Prior Publication Data

US 2011/0041285 A1 Feb. 24, 2011

(30) Foreign Application Priority Data

Apr. 1, 2008 (KR) ..... 10-2008-0030125

(51) Int. Cl.
*E05F 1/08* (2006.01)
*E05F 3/20* (2006.01)

(52) U.S. Cl.
USPC ..... 16/306; 16/299; 16/50; 16/54; 16/307

(58) Field of Classification Search
USPC ..... 16/50, 54, 280–285, 330, 303, 55, 68, 16/72, 76, 312, 299, 301, 307, 306
See application file for complete search history.

(56) References Cited

U.S. PATENT DOCUMENTS 4,215,449 A * 8/1980 Loikitz ..... 16/50
4,875,252 A 10/1989 Falconer
5,152,029 A * 10/1992 Pai ..... 16/54
5,715,574 A * 2/1998 Schall ..... 16/301
6,119,310 A * 9/2000 Ohshima et al. ..... 16/342

(Continued)

FOREIGN PATENT DOCUMENTS

GB 2281099 A * 2/1995
JP 09158605 A * 6/1997

(Continued)

OTHER PUBLICATIONS

International Search Report for PCT/KR2008/004538 mailed Jan. 8, 2009.

(Continued)

*Primary Examiner* — Chuck Mah
(74) *Attorney, Agent, or Firm* — AKC Patents; Aliki K. Collins

(57) ABSTRACT

The present invention relates to a hinge apparatus for a door, and more particularly, to a separated type hinge apparatus with an automatic return function, in which a restoring device and a damping device are installed separately so that the overall length of the hinge apparatus is reduced, and thus the hinge apparatus may be buried less deeply. A separated type hinge apparatus comprises: an elastic casing; a first elastic member that provides a restoring force; a clutch device which is combined with one end of the first elastic member and controls the elastic force of the first elastic member to remain constant; a shaft penetratively combined through the clutch device in order to transmit a rotational force; and a spring fixing member which is coupled to the other end of the first elastic member and has a gear groove to control a spring elastic force.

34 Claims, 5 Drawing Sheets

(56) References Cited

U.S. PATENT DOCUMENTS

| | | | | |
|---|---|---|---|---|
| 7,117,562 | B2 * | 10/2006 | Zuo et al. | 16/303 |
| 7,155,780 | B2 | 1/2007 | Chen | |
| 7,210,199 | B2 * | 5/2007 | Clark | 16/299 |
| 2004/0068833 | A1 * | 4/2004 | Sawa | 16/60 |
| 2005/0097705 | A1 | 5/2005 | Chen | |
| 2005/0193523 | A1 * | 9/2005 | Nam et al. | 16/330 |
| 2006/0130276 | A1 * | 6/2006 | Clark | 16/299 |
| 2007/0000090 | A1 * | 1/2007 | Wu | 16/299 |
| 2007/0089273 | A1 * | 4/2007 | Kang | 16/330 |
| 2007/0294859 | A1 * | 12/2007 | Hsu et al. | 16/330 |

FOREIGN PATENT DOCUMENTS

| | | |
|---|---|---|
| KR | 20-0357309 | 7/2004 |
| KR | 10-0504944 | 11/2004 |
| KR | 10-0742354 | 7/2007 |
| KR | 10-0776627 | 11/2007 |

OTHER PUBLICATIONS

Written Opinion of the International Searching Authority for PCT/KR2008/004538.

* cited by examiner (a)

(b)

(a)

(b)

(a) (b)

SEPARATED TYPE HINGE APPARATUS WITH RETURN FUNCTION

RELATED APPLICATIONS

This application is a 371 application of International Application No. PCT/KR2008/004538, filed Aug. 5, 2008, which in turn claims priority from Korean Patent Application No. 10-2008-0030125, filed Apr. 1, 2008, both of which are incorporated herein by reference in their entireties.

TECHNICAL FIELD

The present invention relates to a hinge apparatus that provides a closing force to a door, and more particularly, to a separated type hinge apparatus having an automatic return function in which a restoring device and a damping device are installed separately so that the overall length of a hinge apparatus is reduced, and thus the hinge apparatus may be buried less deeply.

BACKGROUND ART

Generally, a door has a hinge apparatus that provides restoration and absorbs shock. But in the conventional hinge apparatus, an elastic member providing restoring force and a damping device absorbing shock are all installed in one casing, thereby increasing the length of the hinge apparatus. And thus a buried type hinge apparatus is required to be buried more deeply, making it difficult to manufacture burying holes depending on door materials.

Further, a certain period of repeated opening and closing of a door lowers a restoring force of an elastic member, thus it needs to be replaced with a new one, or used in a bad state. And when coupling a connection frame of a door with a shaft, inaccurate coupling of an end portion of a shaft with a connection frame of a door makes an initial coupling difficult, thereby worsening the adhesion of a hinge axis and doorframe. And the metal to metal scratching noise is made due to a galled metal.

Korea Patent Publication No. 2001-0027832 discloses a hinge apparatus having an automatic return function. The hinge apparatus has such a complex structure that assembly productivity deteriorates. A compression spring is used as an elastic member for an automatic return, thereby leading to a weakening of the restoring force, and it is difficult to be buried in a door. Further, the conventional hinge apparatus with an automatic return function is not height-controllable when used in a buried type. Thus in the case of a two-door type that opens and closes from both sides, if the doors have different heights, it is difficult to adjust the height of doors at user's discretion.

There is disclosed a hinge apparatus with an automatic return function to solve the problems of the conventional arts.

DISCLOSURE OF INVENTION

Technical Problem

The object of the present invention is to provide a separated type hinge apparatus with an automatic return function, wherein a restoring device and a damping device are separated so that the length of the hinge apparatus is reduced and a restoring force of a restoring device may be controllable. The increased adhesion of a shaft to a supporting member of a door reduces a metal to metal scratching noise, and a height control device enables the height of a door to be easily adjusted.

Technical Solution

According to the preferred embodiment of the present invention, a separated hinge apparatus with an automatic return function includes: an elastic casing; a first elastic member that provides a restoring force; a clutch device which is combined with one end of the first elastic member and controls the elastic force of the first elastic member to remain constant; a shaft penetratively combined through a clutch device to transmit a rotational force to the clutch device; and a spring fixing member which is coupled to the other end of the first elastic member and has a gear groove to control a spring elastic force.

According to another preferred embodiment of the present invention, the externally projected end and mid portions of the shaft are tapered.

According to another preferred embodiment of the present invention, a second elastic member, which is combined between a protrusion formed at one end of the spring fixing member and one end of the shaft, is further included.

According to another preferred embodiment of the present invention, the second elastic member pushes an axis toward a supporting member of a door in order to prevent the noise of the axis and to be firmly combined with a supporting member of the door.

According to another preferred embodiment of the present invention, the first elastic member is a torsion spring.

According to another preferred embodiment of the present invention, a separated type hinge apparatus having an automatic return function further comprises a damping device having an additional damping casing separated from the elastic casing.

According to another preferred embodiment of the present invention, the damping device comprises: a damping casing to form an exterior; a cam member which is coupled into the damping casing and converts a rotational motion into a rectilinear motion; a piston rod coupled with the cam member inside the damping casing; a fluid pressure control rod inserted into a groove formed at one side of the piston rod to thereby control the up/down travel speed of the piston; and an oil for damping, in which the cam member and the piston rod are coupled by a guide pin to enable a rectilinear motion of the piston.

According to another embodiment of the present invention, a damping device further comprises a control bolt combined at the top of the fluid pressure control rod to control the damping speed.

According to another embodiment of the present invention, the control bolt is a pair of control bolts of a gear shape.

According to another embodiment of the present invention, the pair of control bolts has one side which is perpendicularly combined in a shape of bevel gear, so as to be controlled from the side.

According to another embodiment of the present invention, a height control device, through which the externally projected shaft is penetratively combined and controls the height of the hinge apparatus, is further included.

According to another embodiment of the present invention, the height control device is a screw-combining type.

Advantageous Effects

A separated type hinge apparatus with an automatic return function according to the present invention has a restoring device and a damping device that are separated from each other to thereby significantly reduce the needed space. Further, it may be able to be installed inside the door as well as at the bottom surface of the door.

Moreover, the separated hinge apparatus with an automatic return function according to the present invention has advantages in: easily adjusting a restoring force when the restoring force of an elastic member of a hinge deteriorates; increasing adhesion of a shaft to a supporting member of the door by using a spring, to thereby prevent a metal to metal scratching noise generated by a galled axis; and easily adjusting the height of the door by using a height control device.

BRIEF DESCRIPTION OF THE DRAWINGS

FIG. 1(*b*) is a cross-sectional view showing that a restoring device of FIG. 1*a* is coupled.

FIG. 2(*b*) is a cross-sectional view showing that an improved restoring device of FIG. 2(*a*) is coupled.

FIG. 6(*b*) (I) and (II) are cross-sectional views showing that the damping device of FIG. 5(*a*) is combined.

FIG. 6(*c*) (I) and (II) are schematic views illustrating a control bolt.

FIGS. 7(*b*) and (*c*) are cross-sectional views showing that the shaft is combined with a height control device and a supporting member to control height.

MODE FOR THE INVENTION

Hereinafter the present invention will be described in detail with reference to drawings and embodiments, to which the scope of the invention is not limited.

A separated type hinge apparatus according to the present invention comprises a restoring device and a damping device.

Figure 1:
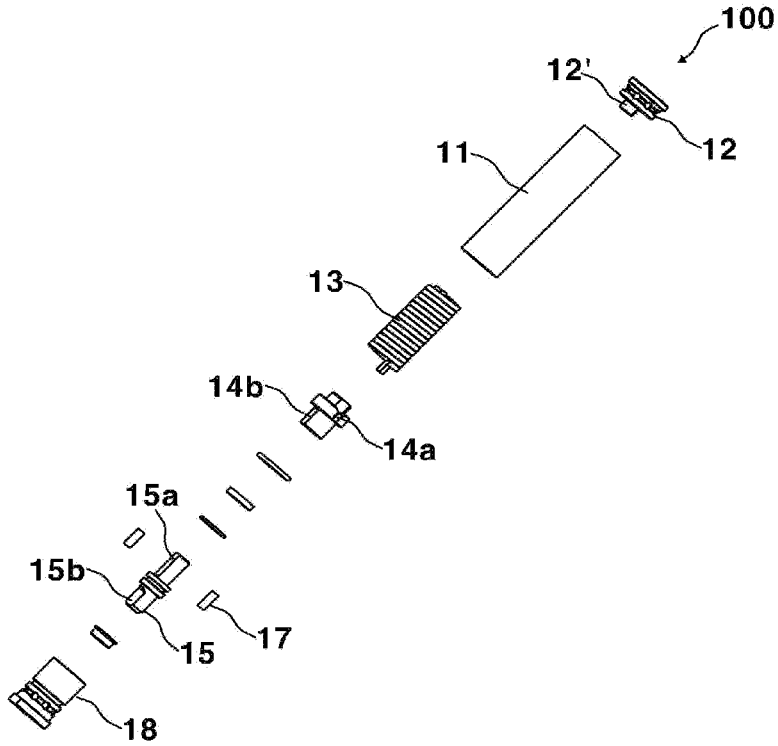
FIG. 1(*a*) is an exploded perspective view of a restoring device that provides a restoring force.
Figure 1:
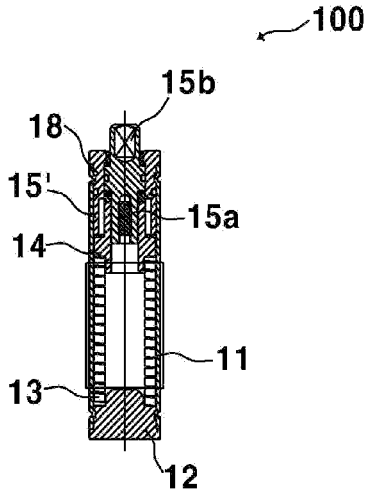

FIG. 1(*a*) shows an exploded perspective view of a restoring device in a separated type hinge apparatus with an automatic return function. And FIG. 1(*b*) shows a cross-sectional view of a restoring device.

The restoring device 100 comprises: an elastic casing 11; END CAP 12 coupled to the top of the elastic casing; an elastic member 13 that is installed inside the elastic member and one end of which is fixed to the END CAP; a clutch device 14 fixed to the other end of the elastic member; and a shaft 15 to revolve the clutch device, in which the END CAP 12 has several holes on its sides to increase its adhesion to the elastic casing 11 when combined.

The elastic casing 11, which may be a shape of a cylinder or a pillar with several angles, may be made of plastic or metal. The elastic member 13 is located inside the elastic casing 11. The elastic member 13 is preferably a torsion spring. Inside the elastic casing 11, one end of the elastic member 13 is fixed by a semi-circular pillar-like protrusion 12' formed at one end of the END CAP 12 which is combined with one end of the elastic casing 11. The other end of the elastic member 13 is combined with a groove 14*a* formed at one end of a clutch device. The clutch device 14 transmits a rotational force from the shaft 15 to the elastic member 13 when opening a door, and when the opening angle exceeds a certain degree, the rotational force of the shaft 15 is not transmitted to the elastic member 13. Specifically, the shaft 15 is inserted into the clutch device 14, and a roller ball 17 is located in a groove 15*a* formed on one outer circumferential surface of the shaft. And on the outside of the roller ball 17 is located a groove 14*b* which is formed on one outer circumferential surface of the clutch device 14. In that case, the roller ball 17 transmits a rotational force of the shaft 15 to the clutch device 14, and thus to the elastic member 13.

In the case of a door revolving at over a certain angle, the roller ball 17 is separated from the groove 15*a* formed on one outer circumferential surface of the shaft, in which the shaft 15 and the clutch 14 each run idle, thereby failing to transmit a rotational force to the elastic member 13. By contrast, if a closing angle of a door is below a certain degree, the once separated roller ball 17 is again combined into the groove 15*a* formed on one outer circumferential surface of the shaft, thereby enabling a rotational force of the elastic member 13 to be transmitted through the clutch device 14 to the shaft 14, leading to an automatic closing of a door. The other side of the shaft 15*b* is tapered, thereby enabling an easy initial insertion and increasing adhesive strength when combined with holes (no figure) formed on the supporting member of the door. Several number of O-RINGs may be combined with the shaft 15 if necessary, in order to increase adhesive strength and prevent leakage of oil or grease. The restoring device 100 may be installed in a buried type at the top or bottom of the door, and the position or method for installing the restoring device 100 may be changeable within the scope of knowledge of one of ordinary skill in the art. Inside the elastic casing 11, the shaft is fixed with insert 15'. The insert 15' is inserted into one end of the inside of the elastic casing 11, and preferably remains inserted into the elastic casing 11 when the elastic casing is separated. The other side of the shaft 15*b* is protruded outside of the elastic casing 11 and is combined with holes (no figure) formed on the supporting member of the door, thereby transmitting a rotational force of the door. And the supporting member may use one, such as a supporting bracket.

Figure 2:
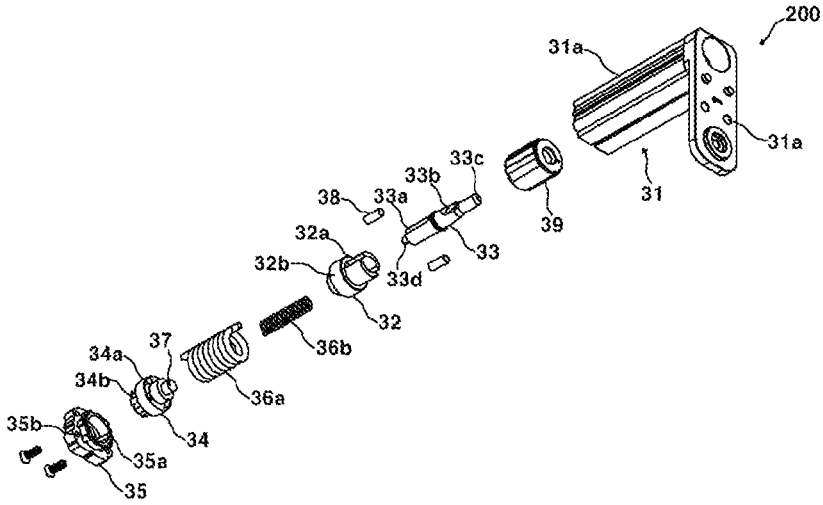
FIG. 2(*a*) is an exploded perspective view of an improved restoring device.
Figure 2:
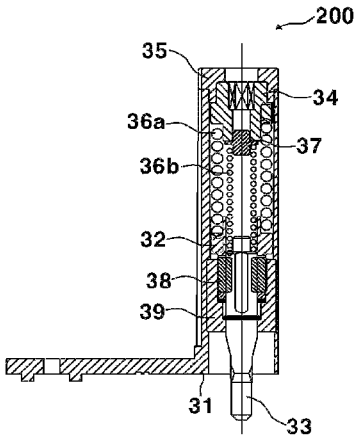

FIG. 2(*a*) is an exploded perspective view of an improved restoring device, and FIG. 2(*b*) is a cross-sectional view thereof.

With reference to FIGS. 2(*a*) and 2(*b*), the improved restoring device 200 is one reformed from the restoring device of FIGS. 1(*a*) and 1(*b*). The improved restoring device 200 comprises: a body 31 which consists of a casing 31*a* and a fixing member 31*b*; a clutch device 32 housed inside the body 31; a shaft 33 penetratively combined through the clutch device 32; a first spring 36*a* coupled to a hole 32*b* formed on one end of the clutch device; a spring fixing member 34 which is coupled to one end of the first spring and on which a gear groove 34*b* is formed to control an elastic force of the first spring; END CAP which is coupled to one end of the spring fixing member 34; and a second spring 36*b* which is combined with a protrusion 37 formed at the other end of the spring fixing member and with one end 33*d* of the shaft, and which is located inside the first spring 36*a*, thereby pushing an axis to prevent the axis noise and to achieve a firm combination with the holes formed on the supporting member of the door.

The casing 31*a* and the fixing member 31*b* that form the body 31 may have a certain angle according to a door, and are preferably perpendicular to each other. The body may be made of a reinforced plastic, an alloy and a stainless steel, etc. Insert 39 fixes a mid-portion of the shaft 33 inside the body. One outer circumferential surface 33*b* of the shaft 33 is tapered in order for the shaft to be easily combined with holes (no figure) formed on the supporting member of the door and to increase adhesive strength. And a smaller diameter of the end of the shaft makes the shaft easy to be initially combined into the holes formed on the supporting member of the door. The clutch device 32 is wrappingly combined to the mid-portion of the shaft 33, the roller ball 38 is coupled to a groove 33*a* formed on the other outer circumferential of the shaft, and a groove 32*a* formed on one outer circumferential of the clutch device 32 is wrappingly coupled on a position of the roller ball. In that case, a rotational force of the present invention is transmitted to the axis. Specifically, if the roller ball 38 is located on the groove 33*a* formed on the other outer circumferential of the shaft 33, and on the outside thereof is located a groove 32*a* formed on one outer circumferential of a clutch device 32, a rotational force of the shaft 33 by the rotation of the door is transmitted to a clutch device 31. And then the rotational force transmitted to the clutch is conveyed to a first spring 36*a* which is combined with holes 32*b* formed on the other side of the clutch device 31. When the revolving angle of the door exceeds a certain degree, the roller ball 38 is separated from the groove 33*a* formed on the other outer circumferential of the shaft 33. In that case, the rotational force of the shaft 33 is not transmitted to the clutch device 32. By contrast, with the roller ball 38 separated, if the closing angle of the door is below a certain degree, the roller ball 38 is coupled to a groove 33*a* formed on the other outer circumferential of the shaft 33, and the restoring force of the first spring 36*a* is transmitted to the shaft 33, leading to an automatic closing of the door of the present invention. A protrusion 33*d* formed at the other end of the shaft is protruded toward the other side of a clutch device. A second spring 36*b* is combined with the protrusion 33*d* by being inserted into a first spring 36*a*. The opposite side of a second spring 36*b* is combined with a protrusion 37 formed at one end of the spring fixing member so as to continuously push the shaft 33, thereby increasing adhesion of the shaft to a supporting member of the door. Several number of O-RINGs may be combined with the shaft 33 if necessary, in order to improve adhesive strength inside the body 31 and to prevent leakage of oil or grease. A hole 34*a* formed at one side of the spring fixing member 34 fixes the first spring 36*a* and several gear groves 34*b* formed at the other side of the spring fixing member 34 control a restoring force of the second spring 36*a*. The restoring force is controllable with every component combined. Specifically, when every component shown in FIG. 3(*a*) is combined, END CAP 35 is combined to one end of the body by screwing a bolt into a screw groove 35*b*. The spring fixing member 34 is rotatably formed even when combined with the END CAP 35, and is treated with oil. A bolt is inserted from the outside through a pair of screw grooves 35*a* that control restoring force and is formed at the END CAP 35. And the bolt is fixedly combined with screw grooves formed on the other side of the spring fixing member 34. That is, a certain amount of elasticity may be initially applied by revolving from the outside the spring fixing member 34 as much as needed. Under the condition of the same revolving angles of a door, if a bolt is screwed from the outside through a pair of the screw grooves 35*a* that control restoring force and are formed on the END CAP 35, a larger amount of restoring force may be obtained. The improved restoring device 2 may be buried at the top or bottom of the door of the present invention. And the installation location and method for burying the restoring device 2 can be changeable within the scope of knowledge of one of ordinary skill in the art.

Figure 3:
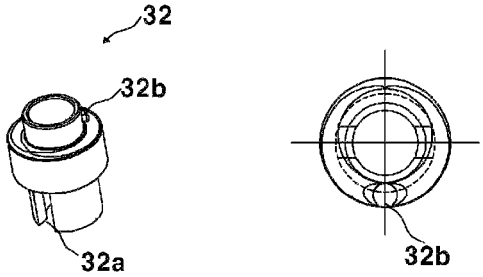
FIGS. 3(*a*) and (*b*) respectively show a perspective view and a plane view of a clutch device.

FIGS. 3(*a*) and 3(*b*) show a perspective view and a plane view of a clutch device.

As described above, a roller ball 38 is coupled to the groove 33*a* formed on the other side of the outer circumferential surface of the shaft 33, and the groove 32*a* formed on one outer circumferential surface of the clutch device 32 is wrappingly coupled to the position of the roller ball. In that case, the rotational force of the door of the present invention is transmitted to the axis. Specifically, the roller ball 38 is coupled to the groove 33*a* formed on the other outer circumferential surface of the shaft 33, and the groove 32*a* formed on one outer circumferential surface of a clutch device 32 is located on the outer circumferential surface of the roller ball 38. In that case, the rotational force of the shaft 33 by a rotation of the door is transmitted to the clutch device 32. And the rotational force transmitted to the clutch device 32 is then conveyed to the first spring 36*a* which is combined into holes 32*b* formed on the other side of the clutch device 32.

The above-said clutch device, for example, may be a clutch device described in Korea Patent No. 776627.

Figure 4:
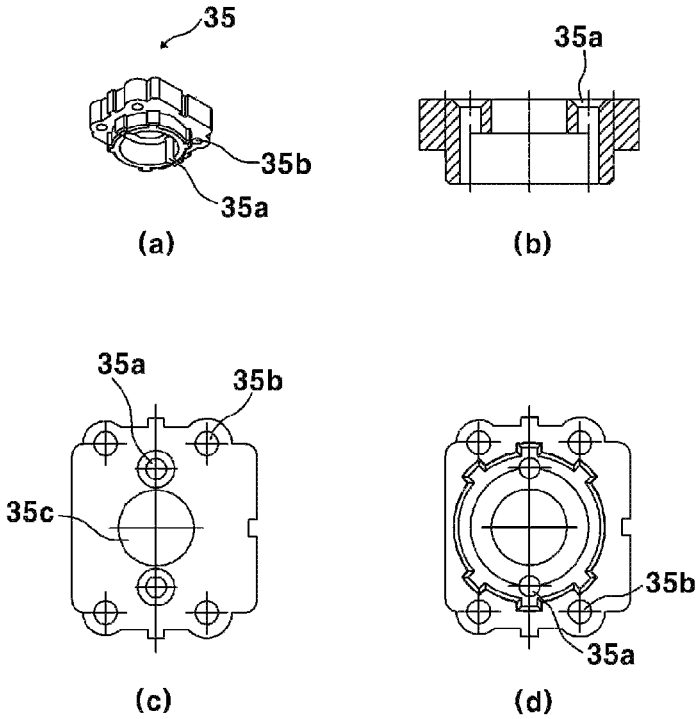
FIGS. 4(*a*), (*b*), (*c*) and (*d*) respectively show a perspective view, a front view, a plane view and a bottom view of an END CAP.

FIGS. 4(*a*), (*b*), (*c*) and (*d*) show a perspective view, a front view, a plane view and a bottom view of END CAP.

END CAP 35 is the last to be combined into a restoring device. As described above, the END CAP 35 is combined with one end of the body by screwing through screw grooves 35*b*, and a spring fixing member 34 is rotated through a hole 35*c* formed at the center portion of the END CAP 35. The spring fixing member is fixed into a pair of screw grooves 35*a*, which control restoring force, corresponding to each other at the center portion. By the process, the restoring force of the first spring 36*a* may be adjustable.

Figure 5:
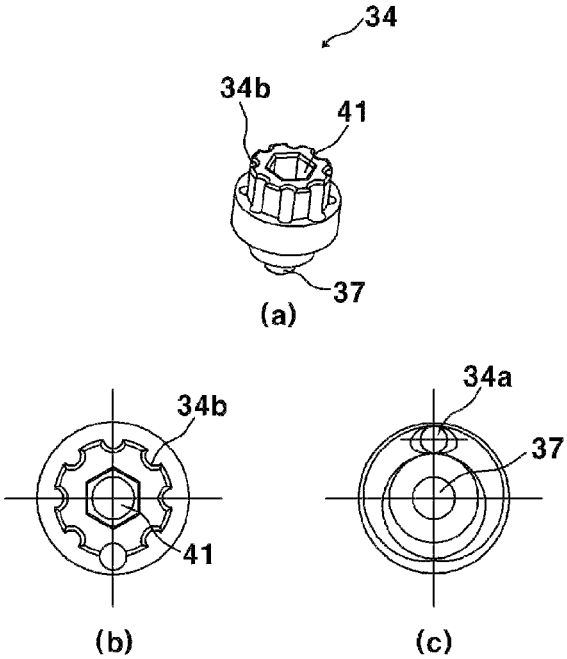
FIGS. 5(*a*), (*b*), and (*c*) respectively show a perspective view, a plane view and a bottom view.

FIGS. 5(*a*), (*b*) and (*c*) show a perspective view, a plane view and a bottom view. The spring fixing member 34 fixes the first spring 36*a* through a hole 34*a* formed on one side of the spring fixing member 34. A protrusion 37 fixes the second spring formed on one end of the spring fixing member. A several number of screw grooves 34*b* formed on the other side of the spring fixing member 34 apply an initial elastic force to the first spring 36*a*. With every component combined, a groove 41 formed at the center portion of the other side of the spring fixing member 34 is used to revolve the spring fixing member 34 through a hole 35*c* formed at the center portion of the END CAP. The groove may be a shape having several angles, preferably may be a hexagon, and may control restoring force conveniently by screwing from the outside with each suitable wrench.

A restoring device 100 and an improved restoring device 200 shown in FIGS. 1(*a*) and 2(*a*) may be inserted into the door of the present invention and may also be housed in the door with a general link unit combined.

Figure 6:
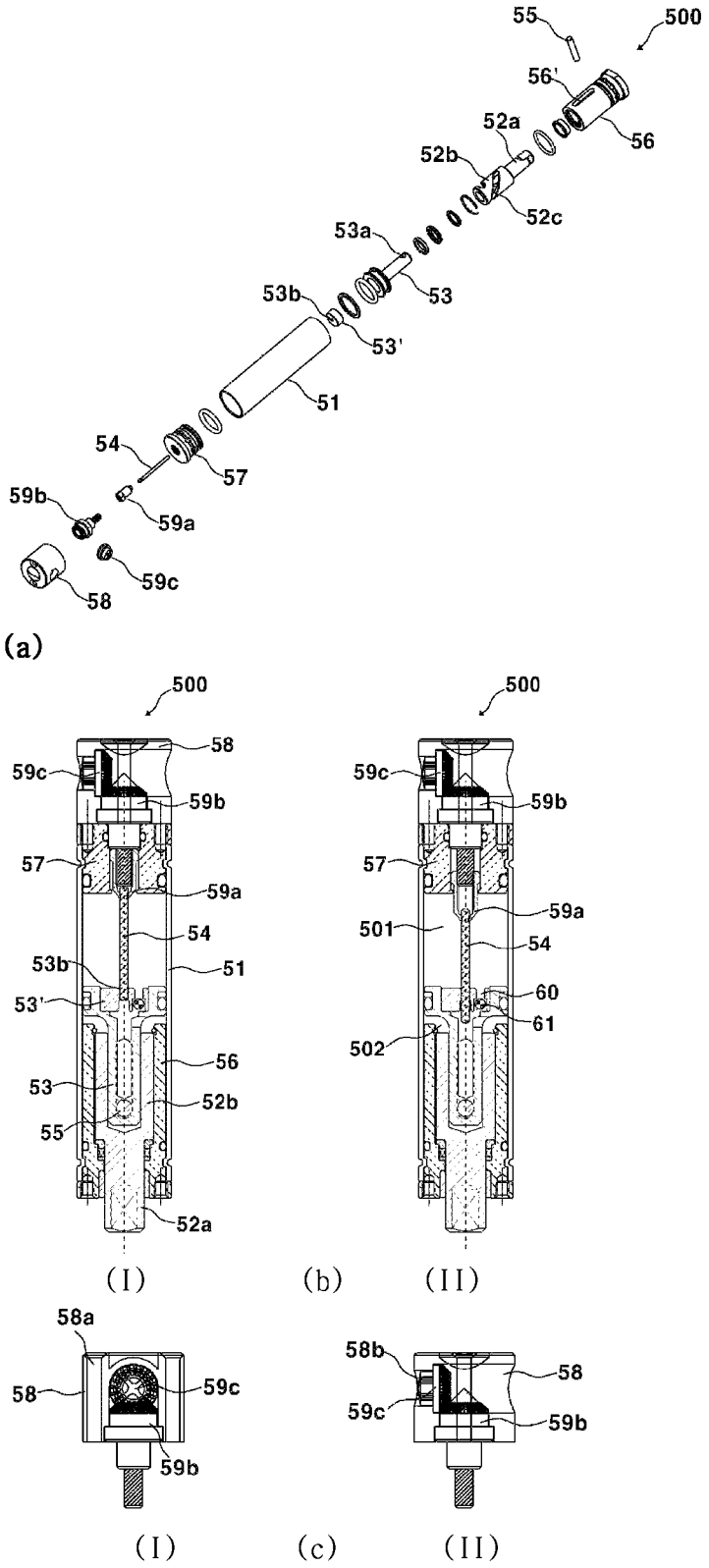
FIG. 6(*a*) is an exploded perspective view of a damping device that absorbs shock.

FIG. 6(*a*) shows an exploded perspective view of a damping device in a separated type hinge device with an automatic return function, and FIG. 6(*b*) shows a cross-sectional view of a damping device with a low damping force. And (I) and (II) of FIG. 6(*c*) show a control bolt.

A damping device 500 comprises: a damping casing that forms an exterior 51; a cam member 52 which is coupled into the damping casing and converts a rotational motion into a rectilinear motion; a piston 53 coupled to the cam member inside the damping casing; a fluid pressure control rod 54 which is inserted into a groove formed at one side of a check valve 53' attached to one side of a piston rod to thereby control the up/down travel speed of the piston; and oil (no figure) for damping, wherein the damping device 500 moves according to the opening and closing of a door. The cam member 52 for converting a rotational motion into a rectilinear motion is housed into the damping casing 51. And an insert 56 is combined to one end of the damping casing 51. A part of the insert 56 is inserted into the inside of the damping casing 51. A roller pin is penetrated through a pair of oval grooves 56' formed to correspond to each other on the outer circumferential surface of the insert, then through a pair of spiral grooves formed to correspond to each other on the outer circumferential surface of a cylindrical portion 52*b* of the cam member 52, and through a hole 53*a* formed on the other side of the piston rod 53. And through the process, the insert 56, a cylindrical portion 52*b* of the cam member 52, and the piston rod are combined. Thus at the time of opening and closing the door, a rotational force of the cam axis 52*a* enables the roller pin 55 to slide along a pair of spiral grooves 52*c* formed on the outer circumferential surface of the cylindrical portion of the cam member 52. And the piston rod 53 through which the roller pin 55 passes makes rectilinear motion. A preferable number of O-RINGs may be combined at the outer circumferential surface of the cam axis 52*a*, the piston rod 53 and oil end cap 57 in order to improve adhesive strength and to prevent leakage of oil. The check valve 53' is attached to one side of the piston rod 53, and one end of the fluid pressure control rod 54 is inserted through the oil end cap 57 into a hole 53*b* formed at the center portion of the check valve. The other end of the fluid pressure control rod is fixed with a fixing nut 59*a*, and a control bolt 59*b* is insertedly combined into a hole formed at one side of the fixing nut. The other side of the control bolt is in a shape of bevel gear or a helical gear, and is combined with a side control bolt 59*c* installed on the side, and having a shape of bevel gear or helical gear, thereby controlling a damping speed of the damping device 500.

Hereinafter, a damping function of the damping device 500 will be described in further detail with reference to (I) and (II) of FIG. 6(*b*) and (I) and (II) of FIG. 6(*c*).

At the time of opening a door of the present invention, the piston rod moves toward a first chamber. Oil inside a first chamber 501 moves toward a second chamber 502 by pushing a ball 61 located at the bottom of cut open portion 60. The ball is pushed through a gap formed between holes 53*b* at the center portion of a check valve into which a fluid pressure control bar is inserted, and through the cut open portion 60 formed at one side of a check valve. On the other hand, at the time of closing the door of the present invention, the fluid pressure control bar 54 is inserted through a hole 53*b* formed at the center portion of the check valve, thereby forming a minute gap through which oil fluxes. In that case, the piston rod 53 turns toward the end of the shaft, and the ball 61 located at the bottom of the cut open portion 60 of the check valve 53' closely adheres to the cut open portion 60, thereby the flux oil through the cut open portion 60 formed at one side of the check valve lessens to a very little amount or disappears. Thus the flux of oil hinders a rectilinear motion of the piston rod 53 and a rotational motion of the cam axis 52*a*, thereby a damping function is performed.

Specifically speaking in terms of controlling the damping speed, the fixing nut 59*a* is inserted through the oil end cap of the damping device 500, and the control bolt 59*b* is combined through a hole formed at the other end of the fixing nut 59*a*. The control bolt is preferably a bolt having a shape of a bevel gear. A side control bolt 59*c* is perpendicularly combined at the top of the control bolt 59*b* and is fixed with a control bolt cover 58. A groove is formed on the opposite side of gear of the side control bolt 59*c*, and faces toward a hole 58*b* formed at the outer circumferential surface of the control bolt cover 58, thereby allowing the side control bolt 59*c* to be turned from the outside through a hole. Thus the control bolt 59*b* pushes the fixing nut 59*a* toward the check valve. The fluid pressure control bar 54, which is fixed at one end of the fixing nut 59*a*, has a diameter that gets larger as it reaches toward the check valve 53'. Therefore as described above, if the fluid pressure control bar 54 is pushed toward the check valve 53', the fluid pressure control bar 54 is inserted through a hole 53*b* formed at the center portion of the check valve. As a result, a minute gap grows larger, thus making the flux of oil more active, and the movement of the piston rod 53 becoming faster. As aforementioned, the side control bolt 59*c* may be turned from the outside of the damping device and the speed of the damping speed may be adjusted.

A separated type hinge apparatus with an automated return function enables the restoring force of a door by a restoring device 100 and by an improved restoring device 200 to be damped by a damping device 500 so that a door closes smoothly, and automatically below a certain angle.

Also the separated hinge apparatus with an automated return function may be applicable to construction materials as well as to a refrigerator.

Figure 7:
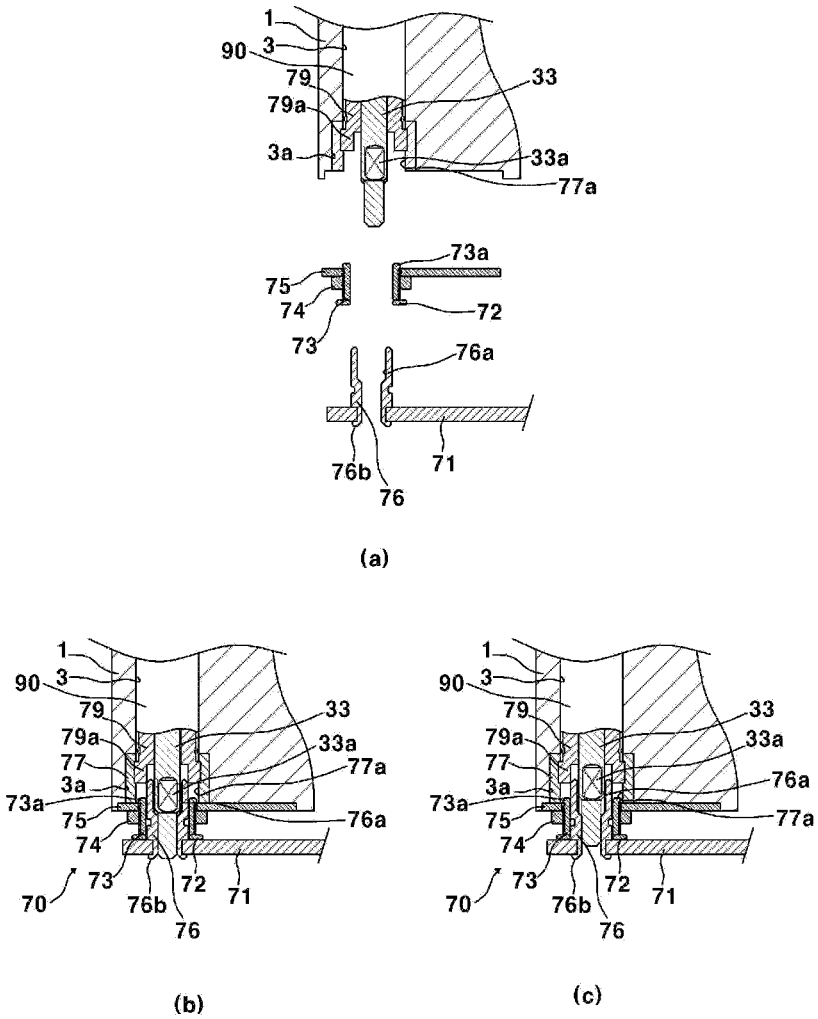
FIG. 7(*a*) is a partial cross-sectional view showing the shaft before it is combined with a height control device and a supporting member.

FIGS. 7 (*a*), (*b*), (*c*) is a cross-sectional view showing before and after the hinge apparatus combines with a control device 70 and a supporting member, and how the height of the hinge device and the door is controlled after combining.

The height control device 70 may be a device disclosed in Korea Patent Application No. 10-2007-0065697 whose description is related to the present invention as reference.

The supporting member may be any supporting member, like bearing (or a supporting bracket) 71, but hereinafter a supporting member specifically refers to a bearing (or a supporting bracket) 71 for a better understanding, but the meaning of a supporting member is not limited thereto.

A height control device comprises: a fixing bracket 75 through which the shaft 33 of a hinge device penetratively combined; and a control bolt with a female screw thread formed at the inner circumferential portion so as to be screwingly coupled to a male screw thread formed at the outer circumferential portion of a through-hole of the fixing bracket 75. And the hinge apparatus and the door with the hinge apparatus buried go up and down according to a rotation of the control bolt 74.

With reference to FIGS. 7(*a*), (*b*), and (*c*), the height control device 70 may control the installation height of the door (1), as the shaft 33 of a hinge apparatus is fixed to a fixing bracket 75 and a supporting bracket 71, and the door 1 has a structure of moving up and down. Korea Patents No. 538195, No. 586262, and Korea Patent Publication No. 2007-14713 disclose a hinge apparatus with an automatic return function which is buriedly inserted into the door and whose shaft is externally projected. Any hinge apparatus having such characteristics may be height-controllable, as the fixing bracket 75 and the control nut 74 are included to control height, like a structure of a height-controllable hinge apparatus.

In the height-controllable hinge apparatus, for example, an upper cap and a lower cap used to close the inside of a hinge apparatus may be coupled at the top and bottom side of the body 90.

Further, the shaft 33 that transmits a restoring force to the door 1 is projected downward through a lower cap 79, and a fixing nut 76 is coupled to the protruded portion of the shaft 33 to have a structure of blocking rotation of the shaft.

In order to be coupled to block rotation of the shaft 33, for example, the leading end portion of the bottom side of the shaft 33 is cut equally so that both opposite surfaces run parallel to have a pair of rectilinear opposite surfaces 33*a*, and the other portions thereof is formed of a structure having opposite curved surfaces. A through-hole 76*a* of the shape corresponding to the leading end portion of the shaft 33 is formed in the fixing nut 76. Therefore, the fixing nut 76 is combined with the shaft 33, thereby blocking rotation.

Further, the shaft 33 is extended in a shape of cylindrical rod at the lower portion of a pair of rectilinear opposite surfaces 33*a*. And a through-hole 76*a* of the fixing nut 76 is extendedly formed in its inner circumference so as to correspond to an extended portion of a shape of cylindrical rod of the shaft 33. The lower portion 76*b* of its outer circumference is inserted into a bearing (or a supporting bracket) 71 of a refrigerator, or a doorframe, or an insertion hole of a bracket installed in a doorframe, and is fixed in e.g. a welding method.

Moreover, the above through-hole of the inner circumferential portion is enlarged to form a space between the lower cap 79 and the shaft 33 so that the leading end portion of the fixing nut 76 may be inserted therein.

Therefore, the shaft 33 and the fixing nut 76 are coupled such that their rotation is blocked, only to be able to make an up/down motion.

Meanwhile, a guide bolt 73 having a male screw thread in the outer circumferential surface is fixedly combined with the outer circumferential surface of the fixing nut 76 between the lower cap 79 and bearing (or a supporting bracket) 71.

A spacer 72 composed of a washer is disposed between the guide bolt 73 and a bearing (or a supporting bracket) 71.

A step portion is formed in a groove 3 of the door 1, a guide housing 77 is fixed in a groove 3*a* at the entrance by using a bonding agent, etc. Four trench type guide grooves 77*a* of the guide housing 77 are, for example, radially formed in a lengthy direction at every 90 degrees.

The upper portion of a lower cap 79 of the height-controllable hinge apparatus is fixedly inserted into the body 90. And at the outer circumference of the lower portion of the lower cap 79, four square-shaped guide protrusions 79*a* are radially formed in a lengthy direction at every 90 degrees to correspond to the four trench type guide grooves 77*a*.

A fixing bracket 75 is fixed in a groove 3*a* of the door 1 using a clamp screw or a fixing bolt (no figure) so as to be at the same level with the lower end surface of the door. The guide bolt 73 is coupled with the inner circumferential surface of the fixing bracket 75 such that the rotation is blocked. A male screw thread is formed in the outer circumferential portion of the guide bolt 73, and at the same time, at least a pair or more, or preferably four trench type guide grooves are arranged in the outer circumferential portion of the guide bolt 73 at every 90 degrees. And four guide protrusions of the fixing bracket 75 to correspond to the four trench type guide grooves are protrudably formed such that the rotation is blocked. In the meantime, the control nut 74 with a female screw thread formed in the inner circumferential portion is screwingly coupled to the outer circumferential portion of the guide bolt 73. A step portion 73*a* of the guide bolt is formed at the upper portion of the outer circumference, and the step portion 73*a* restricts an elevating range within which the door 1 and a hinge apparatus rise up according to a rotation of the control nut 74. If the elevating range of the step portion 73*a* is not limited, an excessive elevation of the door 1 by a user leads to uncoupling of the shaft 33 and the fixing nut 76, making impossible for the hinge apparatus to perform an automatic return function.

Meanwhile, in the case of reversely turning the upper and lower portions in contrast to FIG. 6(*a*), the height-controllable hinge apparatus has the same structure as that of a hinge apparatus having an automatic return function disclosed in Korea Patent Publication No. 2007-14713, and performing the same automatic return function. Therefore, details regarding to this may be omitted.

Hereinbelow the operation mechanism of a hinge apparatus which is buried in the lower end of the door 1 and has a height control function will be described in detail.

The height-controllable hinge apparatus is combined in the grooves 3, 3*a* of the door 1 in a structure of restricted up/down motion. A bearing (or a supporting bracket) 71 at the lower end of the shaft 33 has no elevation restriction, such as a stop ring, etc.

Further, the above-described couplings, by which rotations are blocked, enable the height of the hinge apparatus to be controllable. The hinge apparatus is able to make a rectilinear movement in the up/down direction, and its relative rotation is blocked. And the height-controllable hinge apparatus and the door 1 may revolve, using the shaft 33 and the fixing nut 76, whose rotation is blocked, as a rotational axis. Thus the height-controllable hinge apparatus has a structure of moving up and down with the door 1 simultaneously.

In the height-controllable hinge apparatus having a structure aforementioned, a user may raise the height of the door 1 installed in a bearing (or a supporting bracket) of a refrigerator or in a doorframe, by turning the control nut 74 clockwise. And the height of the door 1 is lowered when the control nut 74 is turned counterclockwise.

Therefore, a user may adjust the installation height of the door 1 in a bearing (or a supporting bracket) 71 or in a doorframe, by simply turning the control nut 74 clockwise or counterclockwise.

As a result, the installation height of two doors of e.g. a two-door type is easily adjusted.

Meanwhile, in the case of the height-controllable hinge apparatus having an automated return function, when a door reaches a predetermined opening angle at which an automatic return function is performed, the height-controllable hinge apparatus housed in the door provides a return force to the shaft 33 and the fixing nut 76 so that the door 1 returns automatically to an initial position.

That is, at the time of closing the door 1, the door 1 rotates clockwise, reaching an opening angle at which a compression spring or a torsion spring provides a return force. Then an elastic restoring force is transmitted to the shaft 33, making the shaft 33 rotate clockwise with the fixing nut 76 which is coupled thereto. In this case, the shaft 33 and the fixing nut 76 are fixed to the supporting bracket 71. Therefore the door 1 which is relatively rotatable and a hinge apparatus which has a height-control function are able to revolve.

A height-controllable hinge apparatus applied to a door of a refrigerator is illustrated herein. However, the hinge apparatus of the present invention may be applied to a variety of electronic appliances and construction materials without much transformation.

Further, female screw threads of the control nut and male screw threads formed in the lower cap or in a guide bolt are arranged in a row. However, a structure of screw combining may be minimized by adopting a structure of several rows.

The present invention is described in detail with reference to drawings and embodiments. One of ordinary skill in the art would be motivated to modify and transform the process conditions of the present invention within the acceptable scope to modify. The scope of the present invention should not be limited by these modifications, but limited only by the claims annexed.

The invention claimed is:

1. A separated type hinge apparatus with an automatic return function comprising:

an elastic casing including:

a first elastic member that provides a restoring force;

a clutch device which is combined with one end of the first elastic member and controls the elastic force of the first elastic member to remain constant;

a shaft penetratively combined through the clutch device to transmit a rotational force to the clutch device, said shaft having an end projected externally from said casing;

a spring fixing member which is coupled to the other end of the first elastic member and has a gear groove to control a spring elastic force; and a second elastic member installed between a protrusion formed at one end of the spring fixing member and one end of the shaft.

2. The separated type hinge apparatus with an automatic return function according to claim 1, wherein an externally projected end and mid portions of the shaft are tapered.

3. The separated type hinge apparatus with an automatic return function according to claim 2 further comprising a damping device which has an additional damping casing separated from the elastic casing.

4. The separated type hinge apparatus with an automatic return function according to claim 3, wherein the damping device comprises: the additional damping casing; a cam member which is coupled into the damping casing and converts a rotational motion into a rectilinear motion; a piston rod coupled with the cam member inside the damping casing; a fluid pressure control rod inserted into a groove formed at one side of the piston rod to thereby control an up/down travel speed; and an oil for damping effect, in which the cam member and the piston rod are coupled by a guide pin to enable a rectilinear motion of the piston.

5. The separated type hinge apparatus with an automatic return function according to claim 4, wherein the damping device further comprises at least one control bolt combined at the top of the fluid pressure control rod in order to control a damping speed.

6. The separated type hinge apparatus with an automatic return function according to claim 5, wherein the control bolt is a pair of control bolts of a gear shape.

7. The separated type hinge apparatus with an automatic return function according to claim 6, wherein one side of the pair of control bolts is perpendicularly combined in a shape of a bevel gear so as to be controlled from the side.

8. The separated type hinge apparatus with an automatic return function according to claim 2 further comprising a height control device through which the externally projected shaft is penetratively combined and which controls the height of the hinge apparatus.

9. The separated type hinge apparatus with an automatic return function according to claim 8, wherein the height control device is a screw-combining type.

10. The separated type hinge apparatus with an automatic return function according to claim 1 further comprising a damping device which has an additional damping casing separated from the elastic casing.

11. The separated type hinge apparatus with an automatic return function according to claim 10, wherein the damping device comprises: the additional damping casing; a cam member which is coupled into the damping casing and converts a rotational motion into a rectilinear motion; a piston rod coupled with the cam member inside the damping casing; a fluid pressure control rod inserted into a groove formed at one side of the piston rod to thereby control an up/down travel speed; and an oil for damping effect, in which the cam member and the piston rod are coupled by a guide pin to enable a rectilinear motion of the piston.

12. The separated type hinge apparatus with an automatic return function according to claim 11, wherein the damping device further comprises at least one control bolt combined at the top of the fluid pressure control rod in order to control a damping speed.

13. The separated type hinge apparatus with an automatic return function according to claim 12, wherein the control bolt is a pair of control bolts of a gear shape.

14. The separated type hinge apparatus with an automatic return function according to claim 13, wherein one side of the pair of control bolts is perpendicularly combined in a shape of a bevel gear so as to be controlled from the side.

15. A refrigerator comprising the separated type hinge apparatus with an automatic return function according to claim 10.

16. The separated type hinge apparatus with an automatic return function according to claim 1 further comprising a height control device through which the externally, projected shaft is penetratively combined and which controls the height of the hinge apparatus.

17. The separated type hinge apparatus with an automatic return function according to claim 16, wherein the height control device is a screw-combining type.

18. The separated type hinge apparatus with an automatic return function according to claim 1, wherein the second elastic member pushes the shaft with a certain force toward a supporting member of a door in order to prevent the noise of the shaft and to be firmly combined with the supporting member of the door.

19. The separated type hinge apparatus with an automatic return function according to claim 18 further comprising a height control device through which the externally projected shaft is penetratively combined and which controls the height of the hinge apparatus.

20. The separated type hinge apparatus with an automatic return function according to claim 19, wherein the height control device is a screw-combining type.

21. The separated type hinge apparatus with an automatic return function according to claim 18 further comprising a damping device which has an additional damping casing separated from the elastic casing.

22. The separated type hinge apparatus with an automatic return function according to claim 21, wherein the damping device comprises: the additional damping casing; a cam member which is coupled into the damping casing and converts a rotational motion into a rectilinear motion; a piston rod coupled with the cam member inside the damping casing; a fluid pressure control rod inserted into a groove formed at one side of the piston rod to thereby control an up/down travel speed; and an oil for damping effect, in which the cam member and the piston rod are coupled by a guide pin to enable a rectilinear motion of the piston.

23. The separated type hinge apparatus with an automatic return function according to claim 22, wherein the damping device further comprises at least one control bolt combined at the top of the fluid pressure control rod in order to control a damping speed.

24. The separated type hinge apparatus with an automatic return function according to claim 23, wherein the control bolt is a pair of control bolts of a gear shape.

25. The separated type hinge apparatus with an automatic return function according to claim 24, wherein one side of the pair of control bolts is perpendicularly combined in a shape of a bevel gear so as to be controlled from the side.

26. The separated type hinge apparatus with an automatic return function according to claim 1, wherein the first elastic member is a torsion spring.

27. The separated type hinge apparatus with an automatic return function according to claim 26 further comprising a damping device which has an additional damping casing separated from the elastic casing.

28. The separated type hinge apparatus with an automatic return function according to claim 27, wherein the damping device comprises: the additional damping casing; a cam member which is coupled into the damping casing and converts a rotational motion into a rectilinear motion; a piston rod coupled with the cam member inside the damping casing; fluid pressure control rod inserted into a groove formed at one side of the piston rod to thereby control an up/down travel speed; and an oil for damping effect, in which the cam member and the piston rod are coupled by a guide pin to enable a rectilinear motion of the piston.

29. The separated type hinge apparatus with an automatic return function according to claim 28, wherein the damping device further comprises at least one control bolt combined at the top of the fluid pressure control rod in order to control a damping speed.

30. The separated type hinge apparatus with an automatic return function according to claim 29, wherein the control bolt is a pair of control bolts of a gear shape.

31. The separated type hinge apparatus with an automatic return function according to claim 30, wherein one side of the pair of control bolts is perpendicularly combined in a shape of a bevel gear so as to be controlled from the side.

32. The separated type hinge apparatus with an automatic return function according to claim 26 further comprising a height control device through which the externally projected shaft is penetratively combined and which controls the height of the hinge apparatus.

33. The separated type hinge apparatus with an automatic return function according to claim 32, wherein the height control device is a screw-combining type.

34. A refrigerator comprising the separated type hinge apparatus with an automatic return function according to claim 1.

* * * * *